US007382349B1

(12) United States Patent
Kuhns

(10) Patent No.: US 7,382,349 B1
(45) Date of Patent: Jun. 3, 2008

(54) METHODS AND SYSTEMS FOR DETERMINING DISPLAY OVERDRIVE SIGNALS

(75) Inventor: Mark D. Kuhns, Peoria, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 625 days.

(21) Appl. No.: 10/955,991

(22) Filed: Sep. 30, 2004

(51) Int. Cl.
*G09G 3/36* (2006.01)

(52) U.S. Cl. ..... 345/102; 345/87; 345/690; 345/204

(58) Field of Classification Search ..... 345/87, 345/102, 204, 690, 211
See application file for complete search history.

(56) References Cited

U.S. PATENT DOCUMENTS 6,304,254 B1 * 10/2001 Johnson et al. ..... 345/204
6,650,340 B1 * 11/2003 Georges et al. ..... 345/690
6,876,347 B2 * 4/2005 Tashiro et al. ..... 345/87
7,095,393 B2 * 8/2006 Lee ..... 345/89
7,277,092 B2 * 10/2007 Shen et al. ..... 345/204

* cited by examiner

*Primary Examiner*—Duc Q Dinh
(74) *Attorney, Agent, or Firm*—Darby & Darby PC; Bruce E. Black

(57) ABSTRACT

A method of operating a display includes operating a pixel of the display using a first signal to provide a first brightness level. A characteristic of the first signal is represented by a value in a range extending from a minimum signal value to a maximum signal value. A second brightness level is then selected and is different from the first brightness level. A truncated table is consulted and contains overdrive values for selected pairs of possible first and second brightness levels. The overdrive values are in a range extending from a minimum table value to a maximum table value, where the minimum table value is less than the minimum signal value or the maximum table value is greater than the maximum signal value or both. An overdrive signal is determined from the overdrive values of the truncated table based on the first and second brightness levels. The pixel is briefly operated using the overdrive signal to facilitate transition to the second brightness level. The pixel is then operated using a second signal corresponding to the second brightness level.

20 Claims, 5 Drawing Sheets

| Final Gray Level \ Initial Gray Level | 0 | 16 | 32 | 48 | 64 | 80 | 96 | 112 | 128 | 144 | 160 | 176 | 192 | 208 | 224 | 240 | 255 |
|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 |
| 16 | 25 | 16 | 0 | 0 | 0 | 0 | 0 | 0 | 0 | 0 | 0 | 0 | 0 | 0 | 0 | 0 | 0 |
| 32 | 50 | 41 | 32 | 6 | 0 | 0 | 0 | 0 | 0 | 0 | 0 | 0 | 0 | 0 | 0 | 0 | 0 |
| 48 | 84 | 73 | 63 | 48 | 20 | 0 | 0 | 0 | 0 | 0 | 0 | 0 | 0 | 0 | 0 | 0 | 0 |
| 64 | 118 | 106 | 95 | 79 | 64 | 32 | 0 | 0 | 0 | 0 | 0 | 0 | 0 | 0 | 0 | 0 | 0 |
| 80 | 141 | 133 | 125 | 110 | 95 | 80 | 48 | 19 | 0 | 0 | 0 | 0 | 0 | 0 | 0 | 0 | 0 |
| 96 | 165 | 160 | 155 | 140 | 126 | 111 | 96 | 78 | 60 | 18 | 0 | 0 | 0 | 0 | 0 | 0 | 0 |
| 112 | 187 | 181 | 175 | 164 | 153 | 140 | 128 | 112 | 94 | 62 | 30 | 0 | 0 | 0 | 0 | 0 | 0 |
| 128 | 210 | 202 | 195 | 187 | 180 | 170 | 160 | 144 | 128 | 107 | 87 | 45 | 3 | 0 | 0 | 0 | 0 |
| 144 | 221 | 215 | 210 | 204 | 199 | 191 | 183 | 171 | 159 | 144 | 123 | 94 | 66 | 38 | 10 | 0 | 0 |
| 160 | 232 | 229 | 226 | 222 | 218 | 212 | 207 | 198 | 190 | 175 | 160 | 145 | 130 | 100 | 70 | 32 | 0 |
| 176 | 239 | 237 | 236 | 233 | 231 | 227 | 223 | 216 | 209 | 198 | 187 | 176 | 161 | 135 | 110 | 76 | 42 |
| 192 | 247 | 247 | 247 | 246 | 245 | 242 | 240 | 234 | 228 | 221 | 215 | 203 | 192 | 171 | 150 | 120 | 90 |
| 208 | 254 | 253 | 252 | 251 | 251 | 249 | 248 | 244 | 241 | 237 | 234 | 225 | 216 | 208 | 187 | 163 | 140 |
| 224 | 255 | 255 | 255 | 255 | 255 | 255 | 255 | 255 | 254 | 254 | 254 | 247 | 240 | 232 | 224 | 207 | 190 |
| 240 | 255 | 255 | 255 | 255 | 255 | 255 | 255 | 255 | 255 | 255 | 255 | 255 | 255 | 251 | 247 | 240 | 223 |
| 255 | 255 | 255 | 255 | 255 | 255 | 255 | 255 | 255 | 255 | 255 | 255 | 255 | 255 | 255 | 255 | 255 | 255 |

FIG. 2

| Final Gray Level \ Initial Gray Level | 32 | 33 | 34 | 35 | 36 | 37 | 38 | 39 | 40 | 41 | 42 | 43 | 44 | 45 | 46 | 47 | 48 |
|---|---|---|---|---|---|---|---|---|---|---|---|---|---|---|---|---|---|
| 16 | 0 | 0 | 0 | 0 | 0 | 0 | 0 | 0 | 0 | 0 | 0 | 0 | 0 | 0 | 0 | 0 | 0 |
| 17 | 2 | 2 | 2 | 2 | 2 | 2 | 1 | 1 | 1 | 1 | 1 | 1 | 1 | 1 | 1 | 1 | 0 |
| 18 | 4 | 4 | 4 | 3 | 3 | 3 | 3 | 3 | 2 | 2 | 2 | 2 | 2 | 1 | 1 | 1 | 1 |
| 19 | 6 | 6 | 5 | 5 | 5 | 5 | 4 | 4 | 4 | 3 | 3 | 3 | 2 | 2 | 2 | 1 | 1 |
| 20 | 8 | 8 | 7 | 7 | 6 | 6 | 6 | 5 | 5 | 4 | 4 | 4 | 3 | 3 | 2 | 2 | 2 |
| 21 | 10 | 10 | 9 | 9 | 8 | 7 | 7 | 6 | 6 | 5 | 5 | 4 | 4 | 3 | 3 | 2 | 2 |
| 22 | 12 | 11 | 11 | 10 | 10 | 9 | 8 | 8 | 7 | 7 | 6 | 5 | 5 | 4 | 4 | 3 | 2 |
| 23 | 14 | 13 | 13 | 12 | 11 | 10 | 10 | 9 | 8 | 8 | 7 | 6 | 6 | 5 | 4 | 3 | 3 |
| 24 | 16 | 15 | 14 | 14 | 13 | 12 | 11 | 10 | 10 | 9 | 8 | 7 | 6 | 5 | 5 | 4 | 3 |
| 25 | 18 | 17 | 16 | 15 | 14 | 13 | 13 | 12 | 11 | 10 | 9 | 8 | 7 | 6 | 5 | 4 | 3 |
| 26 | 20 | 19 | 18 | 17 | 16 | 15 | 14 | 13 | 12 | 11 | 10 | 9 | 8 | 7 | 6 | 5 | 4 |
| 27 | 22 | 21 | 20 | 19 | 18 | 16 | 15 | 14 | 13 | 12 | 11 | 10 | 9 | 8 | 6 | 5 | 4 |
| 28 | 24 | 23 | 22 | 20 | 19 | 18 | 17 | 16 | 14 | 13 | 12 | 11 | 9 | 8 | 7 | 6 | 5 |
| 29 | 26 | 25 | 23 | 22 | 21 | 19 | 18 | 17 | 15 | 14 | 13 | 12 | 10 | 9 | 8 | 6 | 5 |
| 30 | 28 | 27 | 25 | 24 | 22 | 21 | 20 | 18 | 17 | 15 | 14 | 12 | 11 | 10 | 8 | 7 | 5 |
| 31 | 30 | 29 | 27 | 25 | 24 | 22 | 21 | 19 | 18 | 16 | 15 | 13 | 12 | 10 | 9 | 7 | 6 |
| 32 | 32 | 30 | 29 | 27 | 26 | 24 | 22 | 21 | 19 | 17 | 16 | 14 | 13 | 11 | 9 | 8 | 6 |

FIG. 3

| Final Gray Level \ Initial Gray Level | 0 | 16 | 32 | 48 | 64 | 80 | 96 | 112 | 128 | 144 | 160 | 176 | 192 | 208 | 224 | 240 | 255 |
|---|---|---|---|---|---|---|---|---|---|---|---|---|---|---|---|---|---|
| 0 | 0 | -10 | -36 | -48 | -48 | -48 | -48 | -48 | -48 | -48 | -48 | -48 | -48 | -48 | -48 | -48 | -48 |
| 16 | 25 | 16 | -8 | -28 | -48 | -48 | -48 | -48 | -48 | -48 | -48 | -48 | -48 | -48 | -48 | -48 | -48 |
| 32 | 50 | 41 | 32 | 6 | -20 | -42 | -48 | -48 | -48 | -48 | -48 | -48 | -48 | -48 | -48 | -48 | -48 |
| 48 | 84 | 73 | 63 | 48 | 20 | -8 | -36 | -42 | -48 | -48 | -48 | -48 | -48 | -48 | -48 | -48 | -48 |
| 64 | 118 | 106 | 95 | 79 | 64 | 32 | 0 | -18 | -35 | -42 | -48 | -48 | -48 | -48 | -48 | -48 | -48 |
| 80 | 141 | 133 | 125 | 110 | 95 | 80 | 48 | 19 | -10 | -29 | -48 | -48 | -48 | -48 | -48 | -48 | -48 |
| 96 | 165 | 160 | 155 | 140 | 126 | 111 | 96 | 78 | 60 | 18 | -24 | -36 | -48 | -48 | -48 | -48 | -48 |
| 112 | 187 | 181 | 175 | 164 | 153 | 140 | 128 | 112 | 94 | 62 | 30 | 0 | -30 | -39 | -48 | -48 | -48 |
| 128 | 210 | 202 | 195 | 187 | 180 | 170 | 160 | 144 | 128 | 107 | 87 | 45 | 3 | -9 | -20 | -34 | -48 |
| 144 | 221 | 215 | 210 | 204 | 199 | 191 | 183 | 171 | 159 | 144 | 123 | 94 | 66 | 38 | 10 | -7 | -24 |
| 160 | 232 | 229 | 226 | 222 | 218 | 212 | 207 | 198 | 190 | 175 | 160 | 145 | 130 | 100 | 70 | 32 | -5 |
| 176 | 239 | 237 | 236 | 233 | 231 | 227 | 223 | 216 | 209 | 198 | 187 | 176 | 161 | 135 | 110 | 76 | 42 |
| 192 | 247 | 247 | 247 | 246 | 245 | 242 | 240 | 234 | 228 | 221 | 215 | 203 | 192 | 171 | 150 | 120 | 90 |
| 208 | 254 | 253 | 252 | 251 | 251 | 249 | 248 | 244 | 241 | 237 | 234 | 225 | 216 | 208 | 187 | 163 | 140 |
| 224 | 261 | 259 | 258 | 257 | 257 | 256 | 256 | 255 | 254 | 254 | 254 | 247 | 240 | 232 | 224 | 207 | 190 |
| 240 | 268 | 265 | 263 | 263 | 263 | 263 | 264 | 260 | 257 | 256 | 256 | 255 | 255 | 251 | 247 | 240 | 222 |
| 255 | 275 | 272 | 269 | 269 | 269 | 270 | 272 | 266 | 260 | 259 | 258 | 264 | 270 | 270 | 271 | 263 | 255 |

FIG. 4

| Final Gray Level \ Initial Gray Level | 32 | 33 | 34 | 35 | 36 | 37 | 38 | 39 | 40 | 41 | 42 | 43 | 44 | 45 | 46 | 47 | 48 |
|---|---|---|---|---|---|---|---|---|---|---|---|---|---|---|---|---|---|
| 16 | 0 | 0 | 0 | 0 | 0 | 0 | 0 | 0 | 0 | 0 | 0 | 0 | 0 | 0 | 0 | 0 | 0 |
| 17 | 0 | 0 | 0 | 0 | 0 | 0 | 0 | 0 | 0 | 0 | 0 | 0 | 0 | 0 | 0 | 0 | 0 |
| 18 | 0 | 0 | 0 | 0 | 0 | 0 | 0 | 0 | 0 | 0 | 0 | 0 | 0 | 0 | 0 | 0 | 0 |
| 19 | 0 | 0 | 0 | 0 | 0 | 0 | 0 | 0 | 0 | 0 | 0 | 0 | 0 | 0 | 0 | 0 | 0 |
| 20 | 2 | 0 | 0 | 0 | 0 | 0 | 0 | 0 | 0 | 0 | 0 | 0 | 0 | 0 | 0 | 0 | 0 |
| 21 | 4 | 3 | 1 | 0 | 0 | 0 | 0 | 0 | 0 | 0 | 0 | 0 | 0 | 0 | 0 | 0 | 0 |
| 22 | 7 | 5 | 4 | 2 | 1 | 0 | 0 | 0 | 0 | 0 | 0 | 0 | 0 | 0 | 0 | 0 | 0 |
| 23 | 9 | 8 | 6 | 5 | 3 | 2 | 1 | 0 | 0 | 0 | 0 | 0 | 0 | 0 | 0 | 0 | 0 |
| 24 | 12 | 10 | 9 | 7 | 6 | 4 | 3 | 1 | 0 | 0 | 0 | 0 | 0 | 0 | 0 | 0 | 0 |
| 25 | 14 | 13 | 11 | 10 | 8 | 7 | 5 | 4 | 2 | 1 | 0 | 0 | 0 | 0 | 0 | 0 | 0 |
| 26 | 17 | 15 | 14 | 12 | 11 | 9 | 8 | 6 | 5 | 3 | 2 | 0 | 0 | 0 | 0 | 0 | 0 |
| 27 | 19 | 18 | 16 | 15 | 13 | 11 | 10 | 8 | 7 | 5 | 4 | 2 | 1 | 0 | 0 | 0 | 0 |
| 28 | 22 | 20 | 18 | 17 | 15 | 14 | 12 | 11 | 9 | 8 | 6 | 5 | 3 | 2 | 0 | 0 | 0 |
| 29 | 24 | 22 | 21 | 19 | 18 | 16 | 15 | 13 | 12 | 10 | 8 | 7 | 5 | 4 | 2 | 1 | 0 |
| 30 | 27 | 25 | 23 | 22 | 20 | 19 | 17 | 15 | 14 | 12 | 11 | 9 | 8 | 6 | 4 | 3 | 1 |
| 31 | 29 | 27 | 26 | 24 | 23 | 21 | 19 | 18 | 16 | 15 | 13 | 11 | 10 | 8 | 7 | 5 | 3 |
| 32 | 32 | 30 | 28 | 27 | 25 | 23 | 22 | 20 | 19 | 17 | 15 | 14 | 12 | 10 | 9 | 7 | 6 |

FIG. 5

METHODS AND SYSTEMS FOR DETERMINING DISPLAY OVERDRIVE SIGNALS

FIELD

The present inventions are directed to the area of displays, components of displays, and methods of displaying information. In addition, the present inventions are directed to displays, components of displays, and methods of displaying information using interpolation of gray level overdrive signals.

BACKGROUND

In liquid crystal and other displays, the brightness or "gray level" of each pixel of the display can be controlled by variation in a signal applied to that pixel. In the case of liquid crystal displays, a liquid crystal material is typically disposed between two electrodes and is reoriented by application of a voltage across the electrodes. Variation in the voltage applied between the electrodes (e.g., between a threshold voltage and a saturation voltage) can result in different levels of transmission of light through the liquid crystal cell. This phenomenon is sometimes referred to as "gray level" or "gray scale". Manipulation of the gray level can increase the contrast, vibrancy, and accuracy of displayed images.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Detailed Description, which is to be read in association with the accompanying drawings, wherein:

FIG. 2 is an example of a conventional truncated look-up table (LUT) for overdrive voltages;

FIG. 3 is a table containing interpolated overdrive signal values for initial gray levels ranging from 32 to 48 and final gray levels ranging from 16 to 32 based on the values given in the LUT of FIG. 2;

FIG. 4 is an example of a truncated look-up table (LUT) for overdrive voltages with an expanded range of overdrive signal values (+48 from the original range of 0 to 255), according to the inventions;

FIG. 5 is a table containing interpolated overdrive signal values for initial gray levels ranging from 32 to 48 and final gray levels ranging from 16 to 32 based on the values given in the LUT of FIG. 4, according to the inventions;

DETAILED DESCRIPTION

The present inventions are directed to the area of displays, components of displays, and methods of displaying information. In particular, the present inventions are directed to displays, components of displays, and methods of displaying information using interpolation of gray level overdrive signals.

A variety of displays have been developed which utilize individual pixels to display information including, but not limited to, plasma displays, liquid crystal displays (LCDs), and organic light emitting diode (OLED) displays. Such a display typically includes an array of independently addressable pixels. The number of pixels in the array and the size of the display determines, at least in part, the resolution achievable by the display.

Some displays are monochromatic, such as black and white displays, and other displays are color. The number of available colors and the number of shades of color can vary with the display. Some displays have only a limited number of colors, such as 16, 32, or 64 colors. Many color displays, however, are able to generate thousands or millions of different colors. The present inventions can be used with any monochromatic or color display that utilizes gray level variation.

Figure 1:
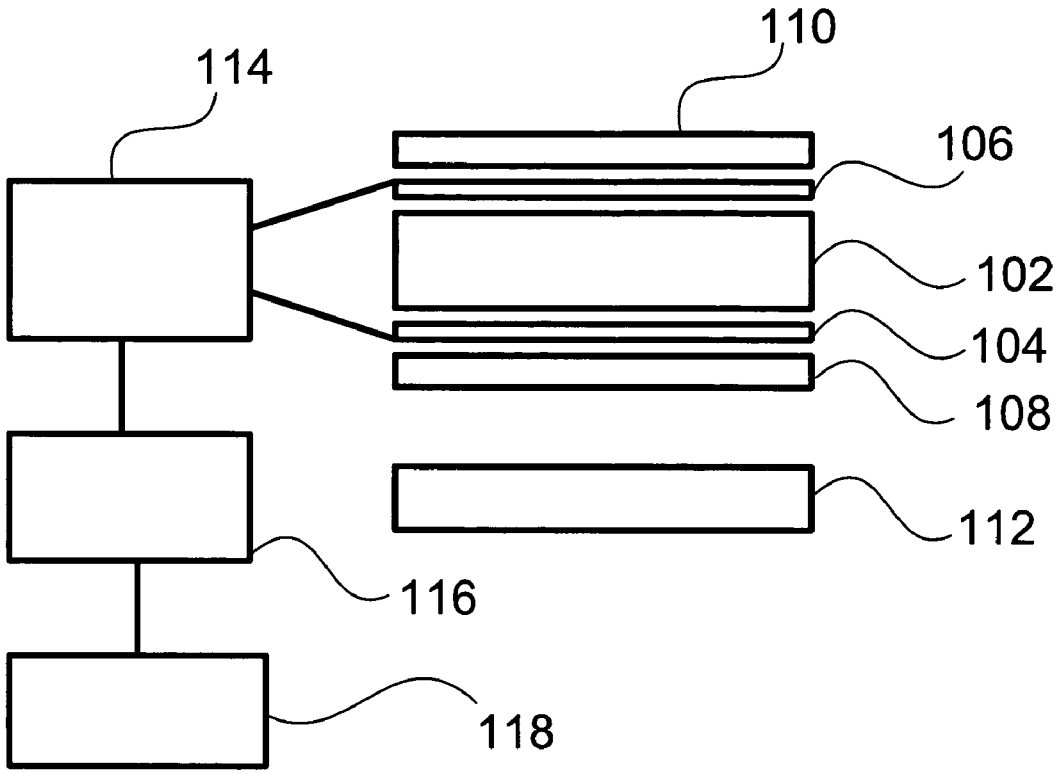
FIG. 1 is a schematic illustration of a transmissive liquid crystal display (LCD)

One example of such a display is a liquid crystal display (LCD). One embodiment of an LCD is schematically illustrated in FIG. 1, although it will be understood that many LCD's include additional or alternative components that are not illustrated in FIG. 1 including, but not limited to, color filters, pre- and postpolarizers, brightness enhancing films, etc. A LCD typically includes a liquid crystal cell with liquid crystal material 102 disposed between two electrodes 104, 106. Any suitable liquid crystal material can be used including, but not limited to, twisted nematic (TN), supertwisted nematic (STN), in-plane switching (IPS), vertically aligned (VA) (including patterned vertically aligned (PVA) and multidomain vertically aligned (MVA)), cholesteric, ferroelectric, and polymer dispersed liquid crystal materials. At least one of the electrodes 104, 106 is an individually addressable electrode so that each of the pixels of the LCD can be individually addressed. The other one of the electrodes 104, 106 can also be individually addressable or it can be a common electrode for all of the pixels.

The liquid crystal material 102, in response to signals from the electrodes 104, 106, can modify the polarization of light incident on the liquid crystal material. In at least some embodiments, the liquid crystal material rotates the polarization of polarized light depending on the orientation of the liquid crystal material. The LCD also includes a polarizer 108 to polarize light incident on the liquid crystal material and an analyzer 110 (also a polarizer) to analyze the light after it has been transmitted through the liquid crystal material. The polarizer and analyzer can be linear or circular polarizers and may have optical axes that are parallel or orthogonal to each other.

The LCD of FIG. 1 is illustrated as a transmissive LCD with light being provided from a backlight 112. Other LCDs are reflective, utilizing, for example, ambient light for illumination of the liquid crystal material, or transflective, utilizing, for example, a backlight and ambient light to illuminate the liquid crystal material.

LCDs can operate in one of at least two different modes depending on the orientation of the polarizers and the initial orientation of the liquid crystal material when there is no signal applied to the electrodes. One mode is "normally black" in which, for a transmissive LCD, no light is transmitted by the LCD when there is no signal applied to the electrodes. Another mode is "normally white" in which, for a transmissive LCD, the maximum amount of light is transmitted by the LCD when there is no signal applied to the electrodes.

Electrical signals are provided to the electrodes 104, 106 using electrical circuitry 114. The LCD can be a passive matrix or an active matrix device or use any other addressing and driving method or device. Control of the signals is typically provided by a processor 116 and its associated memory 118.

The processor 116 and its associated memory 118 (optionally with other components of the LCD, such as the electrical circuitry 114 and electrodes 104, 106) can operate as a display control device. The processor 116 can be any processor that can operate the LCD. The processor 116 can include a microprocessor and, optionally, other electronic circuitry including the real-time compensation circuit illustrated in FIG. 7 and described below.

The memory 118 can include information, such as look-up tables and software, used by the processor to operate the LCD. Alternatively, any software function can be performed by hardware or by a combination of software and hardware.

In a typical LCD, the electric field generated by providing a voltage between the electrodes 104, 106 corresponding to a particular pixel typically determines the orientation of the liquid crystal material of that pixel. The orientation of the liquid crystal material generally determines the degree of modification of the polarization of light transmitted through the liquid crystal material of the pixel. Modification of the polarization will, in turn, result in variation in the brightness of the pixel. The orientation, and correspondingly, the degree of modification of the light polarization, can be altered by altering the signal (e.g., voltage) applied to the electrodes. Typically, the liquid crystal material will reorient if the electric signal is above a threshold signal level (e.g., a threshold voltage). Furthermore, applying a signal greater than a saturation signal level (e.g., a saturation voltage) will generally achieve little or no additional reorientation of the liquid crystal material.

In many displays, the brightness of the individuals pixels can be varied. This can increase the ability of the display to convey information and to produce, for example, more colorful and more realistic images. Harkening back to black and white displays, the variation in brightness is often referred to as "gray level" or "gray scale". It will be appreciated that, although gray refers to gradations between black and white, "gray level" variation in brightness for other colors will generate shades of that color or, when the display forms a color image using a composite of pixels of different colors (e.g., red, green, and blue pixels), variation in gray scale for each pixel will result in variation of color.

For many LCDs, variation in the applied voltage (between the threshold voltage and the saturation voltage) applied to electrodes associated with a pixel in a liquid crystal display (LCD) will alter the amount of light transmitted by the pixel. This results in variation in the gray level or brightness level of the pixel. The terms "threshold level", "threshold voltage", and the like will be used to identify one endpoint of the gray level variation and the terms "saturation level", "saturation voltage", and the like will be used to identify the other endpoint of the gray level variation.

Typically, variation in gray level is not linear with variation in the applied signal. Because of the non-linear nature of the gray level variation, an algorithm can be used to model gray level as a function of the applied signal or a look-up table (LUT) (based upon, for example, an algorithm or empirical observations) or the like can be employed to provide fixed values for the appropriate signals (e.g., voltages) to achieve a desired gray level. Alternatively, the LUT can be truncated to provide the appropriate signal for only a subset of possible gray levels and the signal for any other gray level can be determined by interpolation between those provided in the LUT. The gray level variation can also be achieved using hardware components such as, for example, an addressable resistor string in which variation in resistance produces variation in gray level.

Liquid crystal and other displays naturally take time to adjust when a new signal is applied to the individual pixels. In the case of liquid crystal displays, a change in voltage causes the liquid crystals to reorient. This reorientation takes a finite period of time after the new signal has been provided to the pixel. Because the reorientation can take more time than is required for one or more video frames, it is often desirable to reduce this time for reorientation of the liquid crystal material of the pixel. To facilitate this transition and decrease the time to switch from a first state to a second state, an overdrive signal (e.g., an overdrive voltage) can be applied briefly. If $S_i$ represents the initial signal and $S_f$ represents the final signal, then an overdrive signal, $S_o$, is selected where $|S_o-S_i|>|S_f-S_i|$. For example, if the final signal is greater than the initial signal, than the overdrive signal is generally greater than the final signal. Conversely, if the final signal is less than the initial signal, then the overdrive signal is generally less than the final signal.

The overdrive signal facilitates achieving the final state because the reorientation of the liquid crystal material is not a linear process. In other words, the reorientation begins rapidly and then proceeds more slowly over time until the final state is reached. By applying the overdrive signal for a brief period of time, the reorientation of the liquid crystal material is being driven to a larger change. Thus, the amount of liquid crystal reorientation that occurs, for a given period of time, is greater using the overdrive signal than could be achieved if the final signal were applied instead. Applying the overdrive signal for a brief period of time will generally cause the transition to the new state to occur faster. For example, if the initial signal is 2 V and the final signal is 1.5 V, then applying an overdrive signal briefly at 1 V can decrease the transition time to the final state. The 1.5 V final signal can then be applied.

The overdrive signal is a non-linear function of the initial and final gray levels or brightness levels. The appropriate overdrive signal can be determined using algorithms or, more commonly, look-up-tables (based on algorithms or empirical observation.) The values for the overdrive signals can be selected based on any criteria including, for example, power consumption, the display refresh rate or frame rate, the liquid crystal reorientation rate, and the like. In one embodiment, the overdrive signals are selected to achieve the desired reorientation of the liquid crystal material in about one frame or less. For example, if the refresh or frame rate is 60 Hz, the time for one frame is about 17 milliseconds. The value of the overdrive signal is selected to achieve the desired reorientation in about 17 milliseconds or less. In some embodiments, the overdrive signal may be selected to achieve the reorientation in about one frame so that the reorientation of the liquid crystal will not be driven past the desired state. The degree of reorientation resulting from application of the overdrive signal can be controlled by the magnitude of the overdrive signal and the amount of time during which the overdrive signal is applied.

If one creates a LUT that includes all of the possible permutations of initial and final gray levels or brightness levels, a large amount of LUT memory would be needed. The number of memory bits per overdrive signal LUT is given as $N(2^{2N})$ where $2^N$ is the number of gray levels in the system and N is the number of bits needed to individually identify each of the gray levels. Each LUT is N bits wide with $2^{2N}$ address locations per LUT. Thus, the LUT for a 6-bit LCD system requires 24,576 memory bits, while 8- and 10-bit systems require 524,288 bits and 10,485,760 bits, respectively.

As an alternative, a truncated LUT containing only selected initial and final gray levels is often used. For example, in an N-bit LCD system where the LUT only contains entries for M most significant bits (e.g., if M=4 and N=8, then the initial gray level and final gray level entries are each separated in the LUT by $2^{N-M}$=16 units), the number of memory bits per LUT becomes $4N(2^{2M})$ given a 4-point interpolation. If M=4, then for 6-, 8-, and 10-bit systems, the number of memory bits per LUT becomes 6144, 8192, and 10,240, respectively. In at least some embodiments, consulting the truncated LUT in memory can provide values similar to consulting a table on paper and identifying the two initial signal values and two final signal values bracketing the actual initial and final signal values to obtain four overdrive signal values. These four overdrive signal values can then be interpolated using any interpolation method to estimate or determine an appropriate overdrive signal. Suitable interpolation methods include, for example, 4-point interpolation methods, such as 4-point bi-linear interpolation or the like, but other interpolation methods, some of which use a different number of points, can also be used.

Because the overdrive signal can only take a value between the threshold signal level and the saturation signal level, the overdrive signal values in the LUT represent this range. As an example to illustrate the inventions, if an 8-bit system is used then the threshold signal level or minimum signal level can be represented by a value of 0 and the saturation signal level or maximum signal level can be represented by a value of 255 ($2^N-1$, where N is the number of bits needed to individually identify each gray level). It will be understood that these values are generally not actual physical parameters but represent such parameters. The numbers ranging from 0 and 255 generally represent uniform (e.g., linear) steps in gray level or brightness level as viewed by the human eye. It will be recognized, due to the non-linear nature of gray level, these are generally not uniform steps in the signal parameter (e.g., voltage between electrodes). It will be further understood that any pair of values can be selected for the threshold and saturation signal levels. In this example, each entry in the LUT has a value ranging from 0 to 255. FIG. 2 illustrates a truncated LUT according to this conventional method.

The method described above for interpolation based on the truncated LUT typically can work well where the LUT values for the response curves of the display are generally piecewise-linear. This method does not work well, however, near the threshold and saturation points because the values in the LUT are clamped at the threshold and saturation values. In the LUT illustrated in FIG. 2, the minimum table value is equal to the minimum signal value and is 0 and the maximum table value is equal to the maximum signal value and is 255. Because of this clamping, interpolation generally does not approximate the response curve very well near the threshold and saturation points. This can result in undesirable shading artifacts because of inaccuracies in the overdrive signal.

FIG. 3 illustrates interpolated overdrive signal values for initial gray levels ranging from 32 to 48 and final gray levels ranging from 16 to 32 based on interpolation of the values enclosed in the box in the LUT of FIG. 2. Looking at the upper left to lower right diagonal of FIG. 3 (values enclosed in boxes), which represents a decrease of 16 gray level units from the initial gray level to the final gray level, one would expect that the values along this diagonal should be the same or increase or decrease monotonically. In FIG. 3, however, this is not the case, the values along this diagonal, from left to right, increase from 0 to 10 and then decrease to 6.

To provide a better overdrive signal at these values, a modified LUT can be used which allows overdrive signal values in the LUT that are below the threshold or minimum signal value (e.g., below 0 in the example) and/or above the saturation or maximum signal value (e.g., above 255 in the example). In other words, the minimum table value is below the minimum signal value and/or the maximum table value is greater than the maximum signal value. Such a table is illustrated in FIG. 4 where the possible overdrive signal values for the table range from a minimum table value of −48 to a maximum table value of 303 (which corresponds to 255+48). The use of these extended values can result in more precise interpolation of overdrive signals near the maximum and minimum signal values. Interpolation can be performed using software, hardware, or combinations of software and hardware.

The range of the extension (e.g., ±48 in the LUT of FIG. 4) can be the same above the maximum signal value as below the minimum signal value; or the ranges of the extensions above the maximum signal value and below the minimum signal value can be different. In the example illustrated in FIG. 4, the range of the extension is 48 for both the minimum and maximum signal values. The range of the extension can be selected based upon a variety of factors. In one embodiment, the range of the extension is based on calculations that determine what overdrive signal values in the LUT will, upon interpolation, provide correct values for gray levels at or near the minimum and maximum signal values.

FIG. 5 illustrates interpolated overdrive signal values for initial gray levels ranging from 32 to 48 and final gray levels ranging from 16 to 32 based on the values enclosed in the box in the LUT of FIG. 4. Observing the upper left to lower right diagonal of FIG. 5 (values enclosed in boxes), the interpolated overdrive signal values increase monotonically from 0 to 6 as expected. Thus, a LUT with an expanded range of overdrive signal values can assist in providing better approximations to the actual overdrive response curves by interpolation. The overdrive response curves near the threshold and saturation points are now approximated as piece-wise linear by the extended LUT.

It will be recognized that if, as a result of interpolation or observation of the LUT, the resulting overdrive signal value from the LUT is greater than the saturation signal then the overdrive signal should be set to the saturation signal. In addition, if the resulting overdrive signal value from the LUT is less than the threshold signal, the overdrive signal should be set to the threshold signal. Once the overdrive signal value has been determined from the LUT, the corresponding overdrive signal (e.g., the overdrive voltage) can be applied briefly to the electrodes to generate the desired response of the pixel. The second signal will then be applied to the electrodes afterwards to provide the desired second or final brightness level or gray level from the pixel.

Figure 6:
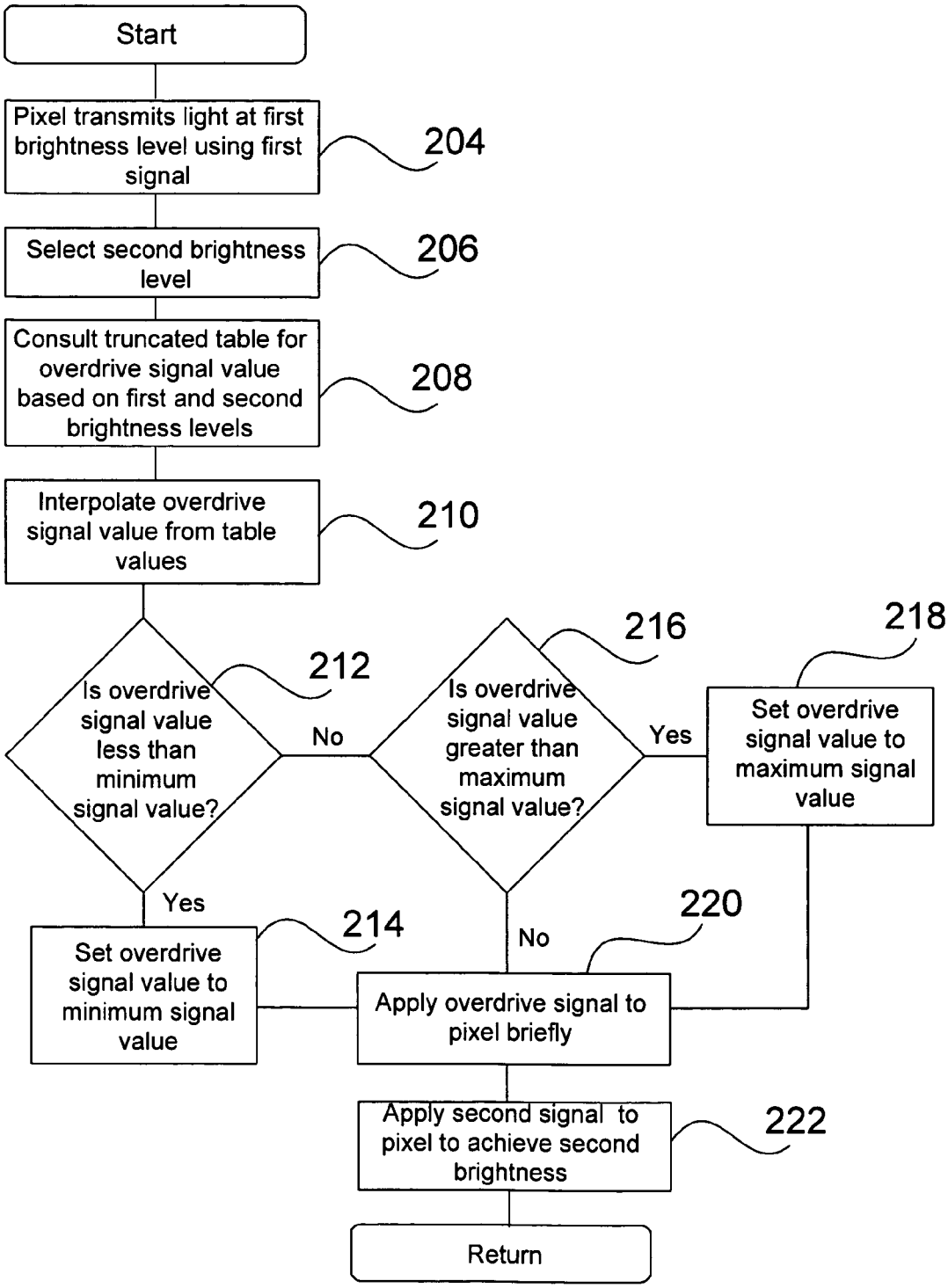
FIG. 6 is a flow chart of one method of selecting an overdrive signal, according to the inventions.

One example of a method for selecting overdrive signals is illustrated in the flow chart of FIG. 6. The flow chart illustrates a method for a single pixel of a display. It will be recognized that all pixels of the display can be managed simultaneously or sequentially in the same or similar manner. From a start block, a pixel transmits light at a first brightness level or gray level with a first or initial signal (e.g., in the case of a LCD, a first or initial voltage) applied to the electrodes (block 204). As the image on the display changes, a second or final brightness level will be selected to display the image (block 206) The first and second brightness levels can be represented by values ranging from a minimum signal value (e.g., a value represented by 0 in the example above) to a maximum signal value (e.g., a value represented by 255 in the example above). In at least some embodiments, the minimum signal value corresponds to a threshold level and the maximum signal value corresponds to a saturation level.

To determine an overdrive signal and facilitate the transition from the first brightness level to the second brightness level, a truncated LUT containing overdrive signal values for selected pairs of first and second brightness levels is consulted (block 208). This truncated LUT has values that are in a range that extends beyond the minimum and maximum signal values (e.g., a range that extends beyond 0 to 255), as illustrated, for example, by the LUT in FIG. 4. If the pair of first and second brightness levels is not explicitly represented in the LUT so that the overdrive signal value can be read directly from the LUT, then the overdrive signal value is determined by interpolation between values given by the truncated LUT (block 210). Any method of interpolation can be used; for example, a 4-point linear interpolation.

When the interpolation is completed, the resulting overdrive signal value is investigated to determine if it less than the minimum signal value (e.g., the threshold value) that can be applied to the electrodes (block 212). If the overdrive signal value is less than the minimum signal value, then the overdrive signal value is set to the minimum signal value (block 214). If not, then the overdrive signal value is investigated to determine if it is greater then the maximum signal value (e.g., the saturation value) (block 216). If the overdrive signal value is greater than the maximum signal value, then the overdrive signal value is set to the maximum signal value (block 218). It will be understood that comparing the overdrive signal value to the maximum and minimum signal values can occur, instead, in the opposite order.

Once the overdrive signal value is determined, the corresponding overdrive signal (e.g., overdrive voltage) is applied briefly to the pixel (block 220). Finally, the appropriate second signal is applied to the pixel so that light transmitted by the pixel produces the second brightness level (block 222).

Figure 7:
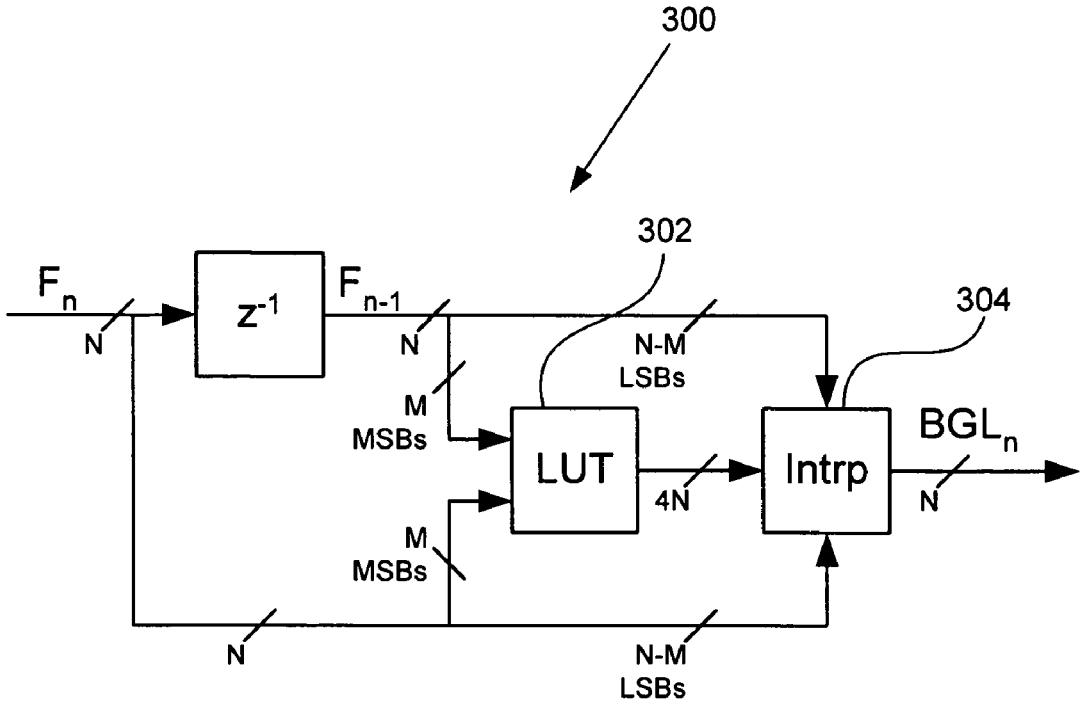
FIG. 7 is a schematic circuit diagram for a response-time compensation circuit using a truncated LUT, according to the inventions.

FIG. 7 schematically illustrates a Response-Time Compensation (RTC) circuit 300. The RTC circuit compares a first signal value $F_{n-1}$ with a second signal value $F_n$ using a truncated look-up table (LUT) 302. N is the number of bits needed to uniquely identify each gray scale and M is the number of most significant bits (MSBs) which are used to determine which gray scale values are represented in the LUT. The LUT provides four N-bit overdrive signal values to an interpolator 304 which determines an overdrive signal value. The RTC circuit can be provided in the form of software, hardware, or any combination of software and hardware.

The above specification, examples and data provide a description of the manufacture and use of the composition of the invention. Since many embodiments of the invention can be made without departing from the spirit and scope of the invention, the invention also resides in the claims hereinafter appended.

What is claimed as new and desired to be protected by Letters Patent of the United States is:

1. A method of operating a display, the method comprising:

operating a pixel of the display using a first signal to provide a first brightness level, wherein a characteristic of the first signal is represented by a first value, $S_i$, in a range extending from a minimum signal value to a maximum signal value;

selecting a second brightness level, different from the first brightness level, wherein the second brightness level corresponds to operating the pixel using a second signal, wherein a characteristic of the second signal is represented by a second value, $S_f$, in the range extending from the minimum signal value to the maximum signal value;

consulting a truncated table which comprises overdrive values for selected pairs of possible first and second brightness levels, the overdrive values are in a range extending from a minimum table value to a maximum table value, wherein the minimum table value is less than the minimum signal value or the maximum table value is greater than the maximum signal value or both;

determining an overdrive signal, and corresponding overdrive value, $S_o$, from the overdrive values of the truncated table based on the first and second brightness levels, wherein $|S_o-S_i|>|S_f-S_i|$;

operating the pixel using the overdrive signal to facilitate transition to the second brightness level; and operating the pixel using the second signal corresponding to the second brightness level after operating the pixel using the overdrive signal.

2. The method of claim 1, wherein the display comprises a liquid crystal display.

3. The method of claim 1, wherein the display comprises a plurality of pixels and the steps of the method are performed for each of the pixels.

4. The method of claim 1, wherein the minimum table value is less than the minimum signal value and the maximum table value is greater than the maximum signal value.

5. The method of claim 1, wherein determining the overdrive signal comprises interpolating an overdrive signal value from the overdrive values of the truncated table.

6. The method of claim 5, wherein, if the overdrive signal value is interpolated to a value less than minimum signal value, then the overdrive signal value is set to the minimum signal value.

7. The method of claim 5, wherein, if the overdrive signal value is interpolated to a value greater than maximum signal value, then the overdrive signal value is set to the maximum signal value.

8. The method of claim 5, wherein interpolating an overdrive signal value comprises bi-linearly interpolating the overdrive values from the truncated table based on the first and second brightness levels.

9. The method of claim 1, wherein the truncated table is a look-up-table stored in a memory element of the display.

10. A method of operating a liquid crystal display, the method comprising:

operating a pixel of the liquid crystal display at a first voltage, $V_i$, to provide a first brightness level, wherein the first voltage is in a range extending from a threshold voltage to a saturation voltage;

selecting a second brightness level, different from the first brightness level, wherein the second brightness level corresponds to operating the pixel using a second voltage, $V_f$, in the range extending from the threshold voltage to the saturation voltage;

consulting a truncated table which comprises overdrive values for selected pairs of possible first and second brightness levels, the overdrive values are in a range extending from a minimum table value to a maximum table value, wherein the minimum table value is less than a minimum signal value representing the threshold voltage or the maximum table value is greater than a maximum table value representing the saturation voltage or both;

determining an overdrive voltage, $V_o$, from the overdrive values of the truncated table based on the first and second brightness levels, wherein $|V_o-V_i|>|V_f-V_i|$;

operating the pixel using the overdrive voltage to facilitate transition to the second brightness level; and operating the pixel using the second voltage corresponding to the second brightness level after operating the pixel using the overdrive voltage.

11. The method of claim 10, wherein the minimum table value is less than the minimum signal value and the maximum table value is greater than the maximum signal value.

12. The method of claim 10, wherein determining the overdrive voltage comprises interpolating an overdrive signal value from the overdrive values of the truncated table.

13. The method of claim 12, wherein, if the overdrive signal value is interpolated to a value less than minimum signal value, then the overdrive voltage is set to the threshold voltage.

14. The method of claim 12, wherein, if the overdrive signal value is interpolated to a value greater than maximum signal value, then the overdrive voltage is set to the saturation voltage.

15. The method of claim 12, wherein interpolating an overdrive signal value comprises bi-linearly interpolating the overdrive values from the truncated table based on the first and second brightness levels.

16. A display control device, comprising:

a pair of electrodes associated with a pixel of a display;

a processor coupled to the electrodes to regulate voltage across the electrodes to control a brightness level of light transmitted by the pixel, wherein the voltage is in a range extending from a minimum voltage to a maximum voltage; and a memory element coupled to the processor and comprising a truncated table which comprises overdrive values for selected pairs of possible first and second brightness levels of the pixel, the overdrive values are in a range extending from a minimum table value to a maximum table value, wherein the minimum table value is less than a minimum signal value representing the minimum voltage or the maximum table value is greater than a maximum signal value representing the maximum voltage or both, wherein for at least one first brightness level and at least one second brightness level there is a corresponding overdrive value, $S_o$, in the truncated table wherein $|S_o-S_i|>|S_f-S_i|$ where $S_i$ is a first value characteristic of a first signal used to operate the pixel at the first brightness level and $S_f$ is a second value characteristic of a second signal used to operate the pixel at the second brightness level.

17. The display control device of claim 16, wherein the minimum table value is less than the minimum signal value and the maximum table value is greater than the maximum signal value.

18. The display control device of claim 16, wherein the processor is configured and arranged to determine an overdrive voltage, $V_0$, using the truncated table to facilitate transition of the pixel from a first brightness level to a second brightness level, wherein $|V_o-V_i|>|V_f-V_i|$ where $V_i$ is a first voltage of the first signal used to operate the pixel at the first brightness level and $V_f$ is a second voltage of the second signal used to operate the pixel at the second brightness level.

19. The display control device of claim 18, wherein the processor is configured and arranged to interpolate the overdrive voltage from values in the truncated table.

20. A display, comprising:

the display control device of claim 1; and liquid crystal material disposed between the pair of electrodes.

* * * * *

UNITED STATES PATENT AND TRADEMARK OFFICE

CERTIFICATE OF CORRECTION

PATENT NO. : 7,382,349 B1
APPLICATION NO. : 10/955991
DATED : June 3, 2008
INVENTOR(S) : Kuhns It is certified that error appears in the above-identified patent and that said Letters Patent is hereby corrected as shown below:

In column 1, line 51, delete "(+48" and insert -- (±48 --, therefor.

In column 3, line 36, delete "individuals" and insert -- individual --, therefor.

Signed and Sealed this

Nineteenth Day of August, 2008

JON W. DUDAS
*Director of the United States Patent and Trademark Office*